US005784974A

United States Patent [19]

Krauss

[11] Patent Number: 5,784,974

[45] Date of Patent: Jul. 28, 1998

[54] SYSTEM FOR IMPROVING FUEL FEED CONTROL OF VOLUMETRIC COAL FEEDERS

[75] Inventor: Kenneth J. Krauss, North Olmstead, Ohio

[73] Assignee: General Signal Corporation, Stamford, Conn.

[21] Appl. No.: 837,842

[22] Filed: Apr. 22, 1997

[51] Int. Cl.[6] ..... F23N 5/18

[52] U.S. Cl. ..... 110/186; 110/101 C; 110/101 CC; 110/292; 414/148; 414/161

[58] Field of Search ..... 110/186, 189, 110/292, 101 R, 103, 101 C, 101 CC, 101 CD, 101 CF; 414/148, 157, 161, 196

[56] References Cited

U.S. PATENT DOCUMENTS

| | | | |
|---|---|---|---|
| Re. 29,132 | 2/1977 | List et al. . | |
| 3,187,944 | 6/1965 | Stock . | |
| 3,476,268 | 11/1969 | Munson . | |
| 3,865,053 | 2/1975 | Kolze et al. . | |
| 3,921,545 | 11/1975 | Ruegsegger . | |
| 4,015,548 | 4/1977 | Schuss . | |
| 4,257,518 | 3/1981 | Stock et al. . | |
| 4,335,683 | 6/1982 | Criswell et al. . | |
| 4,353,427 | 10/1982 | Stock et al. . | |
| 4,373,451 | 2/1983 | Gardner et al. . | |
| 4,430,963 | 2/1984 | Finest | 110/101 C |
| 4,489,664 | 12/1984 | Willliams . | |
| 4,528,484 | 7/1985 | Hafner . | |
| 4,714,396 | 12/1987 | Bernard et al. | 414/161 |
| 4,793,512 | 12/1988 | Krauss . | |
| 4,809,190 | 2/1989 | Homer et al. . | |
| 4,846,081 | 7/1989 | Homer et al. . | |
| 4,895,081 | 1/1990 | Homer et al. . | |
| 4,903,901 | 2/1990 | Kime et al. . | |
| 5,158,024 | 10/1992 | Tanaka et al. . | |
| 5,603,268 | 2/1997 | Kinoshita et al. | 110/186 X |

*Primary Examiner*—Henry A. Bennett
*Assistant Examiner*—Susanne C. Tinker
*Attorney, Agent, or Firm*—Ohlandt, Greeley Ruggiero & Perle

[57] ABSTRACT

A feeder system for measuring and controlling the massed feed rate of particulate fuel material, such as coal particles, made up of a group of volumetric feeders and a gravimetric feeder coupled to the group of volumetric feeders. The system controls the fuel feed rate of the volumetric feeders based upon data communicated from the gravimetric feeder.

5 Claims, 3 Drawing Sheets

SYSTEM FOR IMPROVING FUEL FEED CONTROL OF VOLUMETRIC COAL FEEDERS

BACKGROUND OF THE INVENTION

The present invention relates to a feeder system for feeding particulate fuel material, such as coal particles, to a boiler or the like. More particularly, the invention relates to a feeder system for improving the fuel feed control of volumetric feeders.

The known feeders of particulate fuel material can be generally classified into two types: volumetric feeders which feed the fuel material on a volume basis, i.e., at a rate of so many cubic feet per hour, whereas, gravimetric feeding feeds fuel on a weight basis based on pounds per hour. The earlier used type was the volumetric feeder. However, in the past 30 years or so, if the objective is to achieve reliable and accurate fuel delivery to new boilers, the use of gravimetric feeders has become an industry wide practice.

An appreciation of the operation and employment of gravimetric feeders can be gained by reference to those developed by the Stock Equipment Company, a unit of General Signal Corporation, the latter being the assignee of the present application. Particular reference may be made to the following U.S. Pat. Nos. 3,187,944; 4,257,518; 4,793,512; 4,809,190; 4,846,081; and 4,895,081.

It will be understood that weight-based feeding, using a gravimetric feeder, provides a more consistent energy input (BTU per hour) through elimination of density variation effects in the fuel material due to moisture and material size variations.

A typical pulverized coal fired boiler has a fuel feed system consisting of between 3 and 10 feeders, each feeding a single pulverizer. Each pulverizer will provide the pulverized coal to multiple burners at various elevations of the boiler. The boiler operation, and notably the steam generation rate, is controlled by the boiler distributed control system (DCS). The DCS controls the fuel delivery rate of each feeder; it also controls other process variables such as primary and secondary air flows, which affect boiler operating efficiency and boiler/stack emissions. It will be appreciated that close control over the process variables is required as only a few 10th of a % variation in operating efficiency can involve hundreds of thousands of dollars in savings annually. The single largest annual expense in a coal fired power plant is the fuel cost. An average unit may have a one hundred million dollar annual expenditure for fuel and some of the largest multiple unit plants fuel cost can approach one billion dollars annually.

Accordingly, many new boiler installations are provided with gravimetric feeders so as to deliver the coal on a weight basis, thereby providing the most accurate fuel metering available, typically within ½ of 1% of the DCS demand rate in tons per hour. It is to be noted that the moisture variation of the fuel accounts for the largest portion of the BTU variation of the fuel delivered to the boiler by the gravimetric feeders. If moisture content of the fuel varies 5%, the BTU input to the boiler will vary 5%.

Despite the increasing use of gravimetric feeders to deliver the fuel, many older plants use volumetric feeders to deliver the fuel on a volume basis (cubic feet per hour). With these plants, the BTU variation will be five to six times greater than with gravimetric feeders. The greater variation is caused by the moisture effect on the fuel density and reduction in the volumetric efficiency of the feeders.

Although many boiler installations would like to be able to take advantage of the process of improvements provided by gravimetric feeders, they are unable to do so because of physical space constraints and financial limitations.

It is therefore a primary object of the present invention to improve boiler fuel feed control arrangement for older systems based on volumetric coal feeders.

Another object is to provide a system that will achieve at reduced cost a large portion of the benefits of a totally gravimetric fuel feed system.

SUMMARY OF THE INVENTION

The feeder system of the present invention is a unique combination system for measuring and controlling the mass feed rate of particulate fuel material, such as coal particles, comprising a group of volumetric feeders and a gravimetric feeder coupled to said group of volumetric feeders; and provided with means for controlling the fuel fed from the volumetric feeders based upon data communicated from the gravimetric feeder, whereby the volumetric feeders emulate the operation of the gravimetric feeder.

A more specific feature of the present invention resides in a process control technique for improving fuel feed control utilizing the microprocessor controls of a single gravimetric feeder for inputting the fuel feed characteristics of such gravimetric feeder to the microprocessor controls of the volumetric feeders. Moreover, a communication loop provides transfer of digital signals, representing the material feed properties as determined and fixed by the gravimetric feeder, to the volumetric feeders.

The gravimetric feeder location within the boiler feed system is selected to insure it is feeding the most representative fuel which can be an amount taken as an average among the other feeders. It is also important to design the volumetric and gravimetric feeders with similar feeding arrangements and inlet configurations. System programming functions to control the response of the volumetric feeders to the fuel material changes as measured by the gravimetric feeder. It is to be noted that system programming control parameters prohibit density control changes at the volumetric feeders when material delivery or feeder operation is out of sequence.

Other and further objects, advantages and features of the present invention will be understood by reference to the following specification in conjunction with the annexed drawings, wherein like parts have been given like numbers.

DESCRIPTION OF COAL FEEDING SYSTEMS

Figure 1:
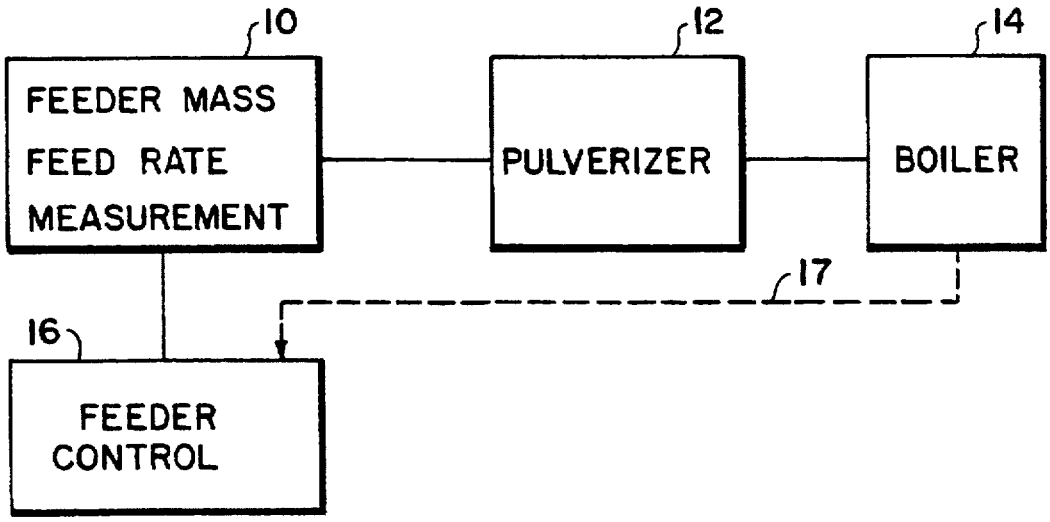
FIG. 1 is a block diagram of the environment or process context in which the present invention is operative.

Before proceeding with the detailed description of a preferred embodiment of the present invention it is considered well to review briefly the history and development of coal feeders and the like embodying two different principles;

that is, they are based on either volume or weight (density) of the coal. An old style volumetric feeder delivers fuel at a variable feed rate by maintaining a constant height and width of material withdrawn from the feeder inlet onto a belt and varying the belt speed. The feed rate is proportional to the drive motor RPM that is, to belt travel, it being understood that although there are other means for conveying particulate material, such as coal, the belt technique is widely employed. A typical 24 inch volumetric feeder will have a 24 inch material width and a 3.9 inch leveling bar height above the belt. The leveling bar height is selected to allow the belt to deliver 2.0 cubic feet per revolution of the drive pulley with a volumetric efficiency of 95%. A pulse output from a switch operated by the drive pulley rotation is used to totalize cubic feet delivered. The volumetric feeder can be appreciated by reference to U.S. Pat. No. 4,793,512.

A typical volumetric feeder control system consists of (1) a start logic circuit controlling the variable speed belt drive motor starter, (2) a motor speed controller, (3) a speed sensor (tachometer generator), and in many installations, (4) an analog feed rate feedback signal source.

The block diagram (FIG. 1) illustrates generically the context of a feeder system as just described as well as the feeder system of the present invention. The context includes a feeder means 10 for measuring out a quantity of particulate material which is then transmitted to a pulverizer means 12 and then to a boiler means 14 for burning of the fuel and recovery of steam or the like. A feeder control 16 acts to control the feeder means 10, and a signal line 17 is for communicating between the boiler means 14 and the feeder control 16, it being understood that electronic control signals, such as demand signals, are transmitted.

As previously noted, the feeder belt travel (motor RPM) is directly proportional to fuel feed rate. This allows the fuel feed demand signal transmitted in a well-known manner to be the input to the motor speed control (forming part of the feeder control 16). By adjusting the maximum and minimum speed potentiometer of the speed control, the maximum and minimum feed rates are selected. In the case of most volumetric feeders, these have been furnished with eddy current clutch drive packages. An AC tachometer integral to the motor/clutch assembly, provides the feedback signal to the motor speed control. The speed control feedback loop utilizes the deviation between the demands signal sent from the boiler means 14 to the feeder means 10 and the feedback signal likewise sent in response to the actual speed at a given time to generate a speed error signal. This error signal is then summed with the input signal to provide speed correction and control.

An additional, separate, feedback signal source has also been provided on many installations to provide feed rate feedback to the boiler control system. The signals were originally provided by an AC tachometer and more recently with a reluctance pick-up and frequency to an analog signal converter.

DESCRIPTION OF PREFERRED EMBODIMENT

Figure 2:
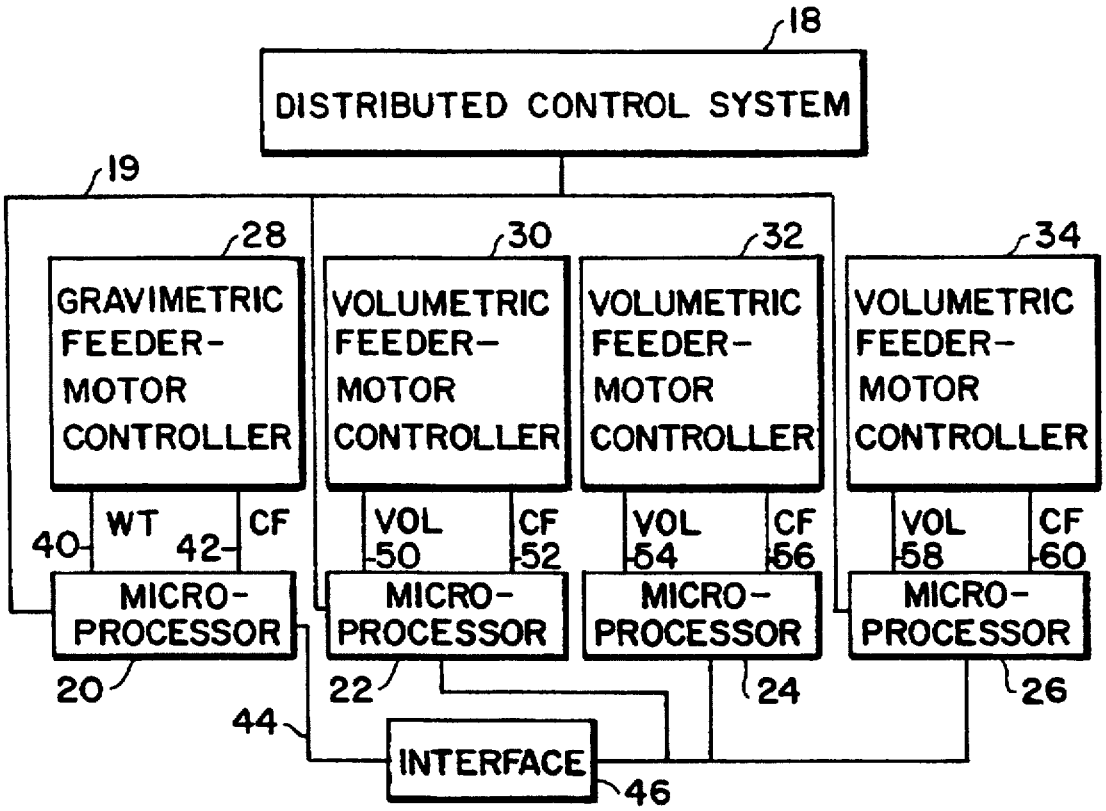
FIG. 2 is a block-schematic diagram of the coal feeding scheme in accordance with a preferred embodiment of the present invention.

Referring now to FIG. 2 of the drawing, there will be seen a preferred embodiment of the system and technique of the present invention. This system and technique embody the concept of combining a group of volumetric feeders with at least one gravimetric feeder, and providing means for controlling the fuel fed from the volumetric feeders based upon data communicated from the gravimetric feeder such that already existing installations, for example, of volumetric feeders can benefit from the advantages found with a gravimetric feeder thereby enhancing the fuel feed characteristics of the volumetric feeders to achieve a far more efficient feeding system.

A distributed control system (DCS) 18, known in the art, for controlling a group of coal feeders is coupled by a two-way bus 19, to an input of each of microprocessors 20, 22, 24 and 26. Microprocessor 20 has another input coupled by line 40 to a gravimetric feeder 28. Each of microprocessors 22, 24 and 26 likewise has another input coupled, respectively, to the volumetric feeders 30, 32 and 34 by respective line 50, 54, and 58.

It will be appreciated that the gravimetric feeder 28, as well as each of the volumetric feeders, has a motor controller for purposes which will be understood; that is, for controlling a motor which drives the belt feeder for feeding coal as in the generic process (seen in FIG. 1). This operation is similar to that of the system described in assignee's U.S. Pat. No. 4,846,081, details of which are incorporated herein by reference. Elaboration of the common aspects between the present invention and that of the patent will be manifest. Thus, in the case of the gravimetric feeder 28, at input line 40, a signal representing the weight (effectively, of density) of a predetermined volume of coal, is sent to the microprocessor 20; and the output line 42 furnishes a control input (CF) to the gravimetric feeder from the microprocessor 20, which acts to control the speed of the feeder 28 by reason of controlling speed of the drive motor (seen in U.S. Pat. No. 4,846,081) for driving typically a belt feeder.

A line or loop 44 serves to connect an interface 46 to each of the microprocessors 22, 24 and 26. This is for the purpose of enabling the intervention of the gravimetric feeder with respect to the volumetric feeders operation, whereby there is constituted a means for controlling the fuel fed from the volumetric feeders based upon the data communicated from the gravimetric feeder 28 via its associated microprocessor 20 and output line 44 therefrom. The interface 46 well-known in the art, operates to permit the volumetric feeders to operate without the intervention of the gravimetric feeder should the gravimetric have a breakdown or for whatever reason be unable to function. However, with intervention of the gravimetric feeder 28, the interface 46 gives priority to passing that feeder's control signal, if present, on output line 44, to feeders 30, 32 and 34. Such control signal at the same time inhibits the passing of the normal, similar control signal from microprocessors 22, 24 and 26 associated with volumetric feeders 30, 32 and 34, respectively.

Each of the microprocessors 22, 24 and 26 has lines 50 and 52, for volumetric feeder 30; lines 54, 56, for volumetric feeder 32; and lines 58 and 60, for volumetric feeder 34 which operates similarly to the lines 40 and 42 in the case of the gravimetric feeder 28; however, for the volumetric feeders the lines 50, 54 and 58 normally, i.e., in the absence of a signal from gravimetric feeder 28, provide digitized signals responsive to volume, rather than to weight or density.

The operation of the individual microprocessor controlled volumetric feeders 30, 32 and 34 and the gravimetric feeder 28 will now be described in order to provide a complete understanding of the present invention.

A microprocessor controlled volumetric feeder, such as feeder 30, is assumed to have a particular form of feeder, namely, a belt feeder such as seen in U.S. Pat. No. 4,846,081. The volumetric feeder adjusts the belt speed—by varying the driving motor speed—to vary the particulate material feed rate. A microprocessor, such as microprocessor 22 (seen in FIG. 2), receives the boiler system demand signals from the distributed control system 18 which are transmitted over the bus 19 to each of the feeders. In general, each of the microprocessors oversees operation on its particular feeder, and a microprocessor control program interprets the operating information from the feeder such that its speed, at any time, is constantly being corrected; and it adjusts the feeder speed, boiler feedback signals, operating status outputs (feeding material along, trip, etc.) and holds in its memory normal operating conditions which have occurred.

Each of the microprocessor calculates the required motor speed using the programmed feeder design parameters and feed material characteristics. The belt speed is measured and is inputted to the microprocessor for comparison with respect to the demand rate so as to generate an error signal. An error signal(difference between demand rate and current speed) is transmitted to the motor speed control as a motor RPM correction. The belt speed is also used by the microprocessor to calculate the material feed rate to generate an output representing material feed rate for feedback to the distributed control system (DCS).

The microprocessor also calculates the fuel feed totals using the programmed feeder operating parameters and the belt speed feedback signal. Material feed totals are shown on a local display and can be totalized remotely by using a programmable output pulse. Separate totals are provided for volume and weight of material fed. The weight of material fed is calculated based on the assumed density programmed into address 02 and the volumetric efficiency programmed into address 13. Because material density varies as much as 20% due to surface moisture and material size, the totalized weight of delivered is not accurate and should only be used for reference.

Microprocessor Control Set-up

The setup of the microprocessor requires entering the program/feeder operating parameters and adjustment or trimming of the system feed rate signals. There are a number of installation specific feeder parameters or instructions that must be entered into memory in order for the feeder to operate. These memory locations, called set-up memories, have a two digit address (00 to 99). Their content can be either an instruction in the form of a single digit number or a parameter which is a value used in the control sequence.

The microprocessor control program for a typical volumetric feeder requires the following address parameters be entered for proper calculation of material feed rate and totalization.

| ADDRESS | FUNCTION | DESCRIPTION |
|---|---|---|
| 02 | Density | Value of material density for use in calculation of motor rpm to meet material feed rate demand |
| 05 | Maximum Feed Rate | Feed rate corresponding to 100% demand (tph) |
| 06 | Minimum Feed Rate | Feeder will not run below this rate |
| 07 | Data Logger Increment | Sets weight of material per data logger pulse |
| 10 | Drive Pulley Diameter | Value is used to calculate the distance the belt moves in 1 revolution of the drive pulley, used in calculating the motor rpm to meet demand feed rate |
| 11 | Area on Belt | Value for material on belt cross-sectional area, used in calculating the motor rpm to meet demand feed rate |
| 12 | Calibration Probe Span | Distance between optional belt travel measurement calibration probe mounting locations |
| 13 | Volumetric Efficiency | Ratio of actual material on belt divided by theoretical, normally 95% for coal (%) |
| 19 | Gear Reduction | Value of the total gear reduction between the motor and drive pulley |
| 25 | Communication Unit Number | Used to assign unique number to the feeder for use with a centralized computer control system for data logging purposes |

The essential operation of the gravimetric feeder 28 has already been described and is very similar to the volumetric feeder or feeders. However, since the gravimetric feeder responds to weight or density of the particulate material there is a constant adjustment of the feed rate based on density, whereas it will be understood that with the volumetric feeder operation the density is selected once for all operating time. It will also be understood that the microprocessor 20 associated with gravimetric feeder 28 will have similar control functions to those displayed in the table for a volumetric feeder microprocessor. However, it will have a program which responds to instantaneous density changes.

The important point to note is that the feeder system of the present invention, seen in FIG. 2, sometimes called a valumetric feeder system, replaces one volumetric feeder in a predetermined group of volumetric feeders with a gravimetric feeder such as feeder 28. As already described, the gravimetric feeder is provided with a digital communication loop 44, to the volumetric feeders to transfer data or information on the changes in the coal and coal-feeding characteristics.

It will now be apparent that the parameters in accordance with the present invention for the feeder system are affected by the changes in material characteristics and that the parameter most affected is the material density. By updating this value based on the material density measured by the gravimetric feeder 28, the accuracy of the totalized weight of material delivered by each volumetric feeder will be significantly improved over the 20% error without the present invention. Thus in the system depicted in FIG. 2, the gravimetric feeder 28, which will deliver and totalize the feed material within ±0.5% and under ideal conditions, will with gradual changes in the material characteristics cause the volumetric feeders 30, 32 and 34 to approach the accuracy of the gravimetric feeder 28.

Figure 3:
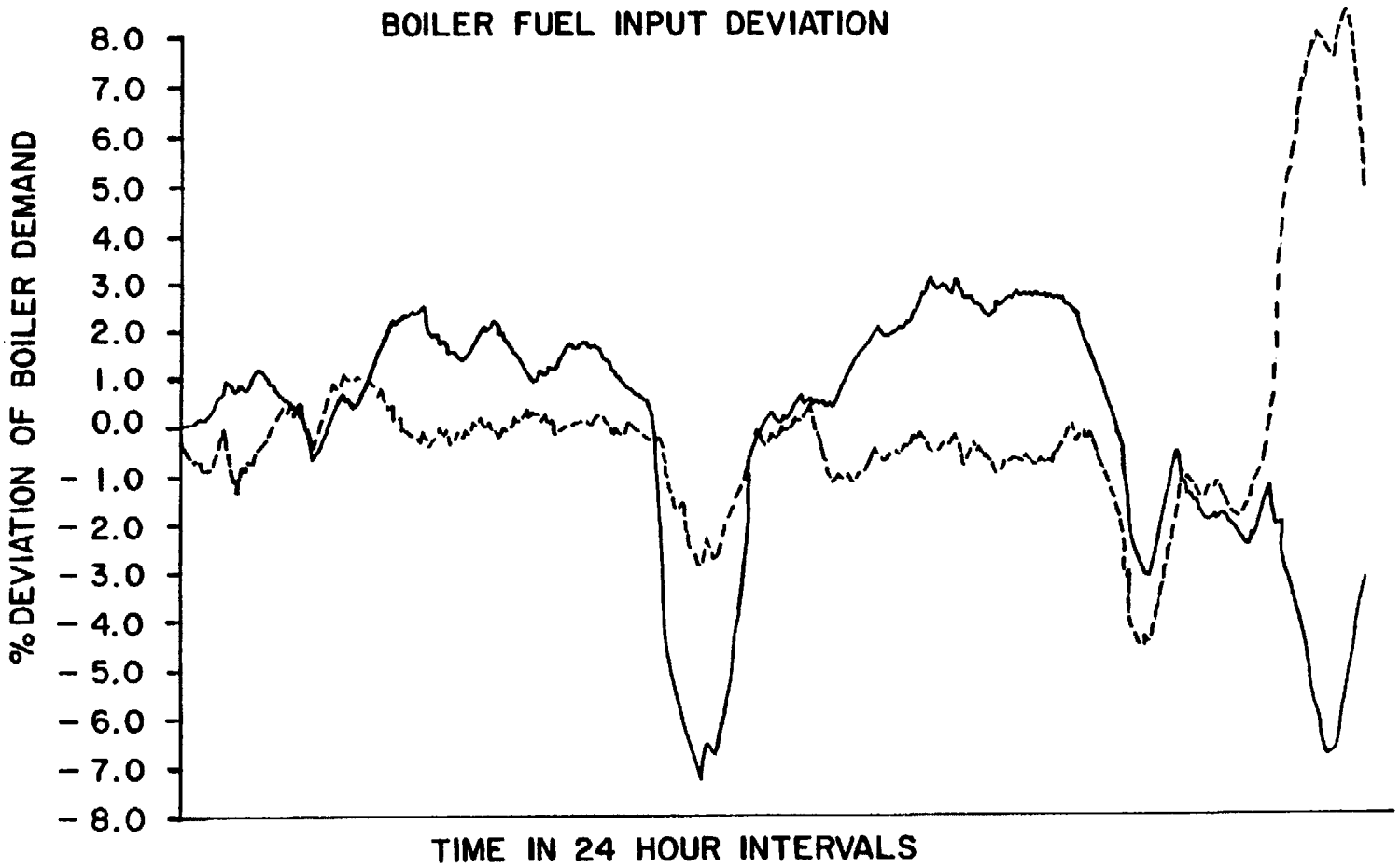
FIG. 3 is an exemplary graph of boiler fuel input deviation as between a volumetric feeder system and a gravimetric feeder system.

The effectiveness in fuel feeding as compared with the prior art can be appreciated particularly with reference to FIG. 3 in which a volumetric graph and a valumetric graph are depicted of boiler fuel input deviation over a time period of several days. FIG. 3 provides graphs of fuel feed rate percent deviation from boiler demand versus time in 24 hour intervals. One curve, volumetric graph, shows the deviation or error for a volumetric system consisting of only volumetric feeders responsive to the volume of feed material. The valumetric graph shows the deviation or error for a valumetric system consisting of one gravimetric feeder responsive to feed material density and the remaining volumetric feeders responsive to the density variation as transmitted by the gravimetric feeder.

Figure 4:
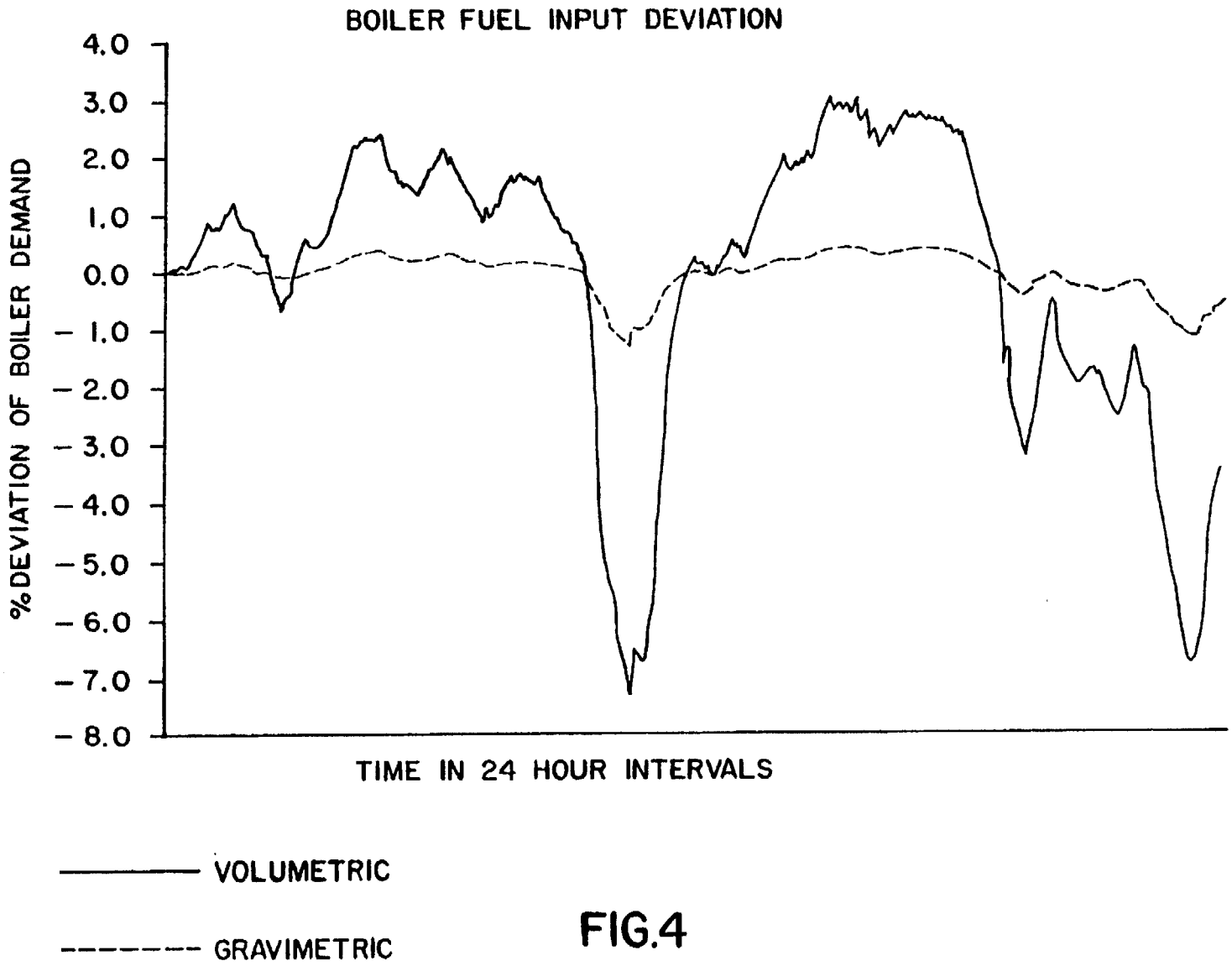
FIG. 4 is another graph of boiler fuel input deviation over twenty-four hour intervals as between a volumetric feeder system and a feeder system in accordance with the present invention (sometimes dubbed a valumetric system).

Turning now to FIG. 4, the graphs illustrate the difference in deviation from boiler demand versus time over a significant period, of 13 days, and compares a purely volumetric scheme or system, shown by the solid curve, with a purely gravimetric system (dotted curve); that is, one where all the feeders are gravimetric or density-responsive feeders. This FIG. 4 shows the sharp difference between the percent deviation for the purely gravimetric where the deviation never goes above zero by more than approximately 0.5% and below zero by more than approximately minus 1%. On the other hand, the purely volumetric feeder system swings widely, moving as high as 3% over time in the plus direction and as much as minus 7% in the negative direction. These graphs are calculated from data collected from a gravimetric system consisting of six gravimetric feeders.

From a comparison of FIGS. 3 and 4, it will appreciated that the system of the present invention swings somewhat more above and below zero percent over the course of time when compared with a purely gravimetric system, but that the improvement over the volumetric is considerable.

What has been disclosed is an improved coal feeding system whose improved accuracy is not only seen in the totalization of the material delivered, but it also provides improved control of the fuel input to the boiler. Such improved fuel feed to the boiler means that higher efficiencies are achieved and better control of boiler emissions. The crucial economic advantage of the present invention resides in the fact that the upgraded system of the present invention can be implemented for about 25% or less of the cost of installing all-gravimetric feeders in place of an all-volumetric feeder system. Also, if the present invention as described is initially implemented, it should be kept in mind that gravimetric feeders may replace more than a single volumetric feeder so that over time an entire volumetric system involving a large number of feeders could be replaced at little extra cost by an all-gravimetric feeder system.

The invention having been thus described with particular reference to the preferred forms thereof, it will be obvious that various changes and modifications may be made therein without departing from the spirit and scope of the invention as defined in the appended claims.

I claim:

1. A feeder system for measuring and controlling the massed feed rate of particulate fuel material comprising:

a group of volumetric feeders, and a gravimetric feeder coupled to said group of volumetric feeders; means for controlling the fuel feed rate of the volumetric feeders based upon data communicated from the gravimetric feeder, said means for controlling including a microprocessor connected to each of said feeders; a loop connected from the microprocessor of the gravimetric feeder to the respective microprocessors of the volumetric feeders; and an interface connected in said loop for selectively transmitting control signals from said gravimetric feeder to said volumetric feeders.

2. A system as defined in claim 1, further comprising an output line and input line connected between each of said microprocessors and its associated feeder, and in which said input line of each microprocessor transmit coal characteristic—responsive signals to said microprocessor and in which said output line transmits control signals to a motor controller for controlling the speed of the associated feeder.

3. A system as defined in claim 2, in which the signals on each input line are responsive to density in the case of the gravimetric feeder, and are responsive to volume in the case of the volumetric feeders.

4. A system as defined in claim 1, further including a distributed control system including means for transmitting demand signals to each of said feeders, for receiving operating signals from said feeders and for transmitting error signals back to each of said feeders.

5. A system as defined in claim 4, in which the demand signals represent the fuel feed rate desired by the boiler for efficient BTU production, the operating signals represent the instantaneous operating fuel feed rate of the feeder motors, and the error signals represent the difference between the two.

* * * * *